US011311066B2

(12) United States Patent
Daddi

(10) Patent No.: US 11,311,066 B2
(45) Date of Patent: Apr. 26, 2022

(54) SYSTEM COMPRISING A FLEXIBLE ELECTRONIC CONTROL UNIT FOR HELMET STRAP WITH FUNCTIONALITIES OF SAFETY, EMERGENCY AND DRIVING ASSISTANCE

(71) Applicant: VDPROJECT S.R.L., Prato (IT)

(72) Inventor: Valentina Daddi, Prato (IT)

( * ) Notice: Subject to any disclaimer, the term of this patent is extended or adjusted under 35 U.S.C. 154(b) by 0 days.

(21) Appl. No.: 17/291,469

(22) PCT Filed: Nov. 4, 2019

(86) PCT No.: PCT/IT2019/050235

§ 371 (c)(1),
(2) Date: May 5, 2021

(87) PCT Pub. No.: WO2020/095337

PCT Pub. Date: May 14, 2020

(65) Prior Publication Data

US 2021/0315303 A1 Oct. 14, 2021

(30) Foreign Application Priority Data

Nov. 5, 2018 (IT) ..... 102018000010043

(51) Int. Cl.

| | |
|---|---|
| ***A42B 3/04*** | (2006.01) |
| ***A42B 3/08*** | (2006.01) |
| ***A42B 3/30*** | (2006.01) |

(52) U.S. Cl.

CPC ..... *A42B 3/046* (2013.01); *A42B 3/08* (2013.01); *A42B 3/30* (2013.01)

(58) Field of Classification Search

CPC .. G08B 1/00; A61B 1/00; A42B 3/046; A42B 3/08; A42B 3/30

See application file for complete search history.

(56) References Cited

U.S. PATENT DOCUMENTS

| | | | | |
|---|---|---|---|---|
| 9,247,779 | B1 * | 2/2016 | Aloumanis | G08G 1/137 |
| 10,905,326 | B1 * | 2/2021 | Lodato | A61B 5/0015 |

(Continued)

FOREIGN PATENT DOCUMENTS

| | | |
|---|---|---|
| WO | 2010005045 | 1/2010 |
| WO | 2015153965 | 10/2015 |

*Primary Examiner* — Albert K Wong

(74) *Attorney, Agent, or Firm* — Woods Oviatt Gilman LLP; Katherine H. McGuire, Esq.

(57) ABSTRACT

The flexible electronic control unit 61 for helmet strap with safety, emergency and driving assistance functionalities can be installed around helmet strap 62, independently from helmet configuration. The electronic control unit is structured to execute Emergency Call or its equivalent in case of accident or fall, taking account of the related European and International regulations, with real-time transmission of user's blood pressure profile and/or derived measures to PSAP and the like while emergency call is ongoing as to support rescue organization. The electronic control unit implements also driving assistance functionalities and remote connection with vehicle control units, such as the peculiar generation of sound alert to reduce vehicle speed as a consequence of uneven bumpy street asphalt detection, as well as the peculiar generation of a synthetized voice message to the user for indications coming from the vehicle about adherence conditions and further information about its own status while travelling.

5 Claims, 3 Drawing Sheets

(56) References Cited

U.S. PATENT DOCUMENTS

| | | | | |
|---|---|---|---|---|
| 2015/0305426 | A1* | 10/2015 | Lee | A61B 5/6803<br>340/539.12 |
| 2016/0331327 | A1* | 11/2016 | Kozloski | A42B 3/046 |
| 2017/0221345 | A1* | 8/2017 | Chen | G08B 25/016 |

* cited by examiner

SYSTEM COMPRISING A FLEXIBLE ELECTRONIC CONTROL UNIT FOR HELMET STRAP WITH FUNCTIONALITIES OF SAFETY, EMERGENCY AND DRIVING ASSISTANCE

The present document describes a system comprising a flexible electronic control unit for helmet strap with functionalities of safety, emergency and driving assistance. The present Description is divided in following chapters: Technical Field, Background Art, Disclosure Of Invention, Description Of Drawings and Best Mode For Carrying Out The Invention.

For the sake of a better reading, the terms and abbreviations known at the state of the art and used in the present document and the relative definitions are collected here below:

- With the abbreviation VIN it is intended the "Vehicle Identification Number" as know at the state of the art, that is as defined in the International Standard ISO 3779:2009;
- With the terms "Emergency Call", "eCall" or "ECall" it is here intended the European automatic emergency call and message alert system, considering EN 16072:2015 or EN 16102:2011 and EN 15722:2015 respectively and the related technical specifications which apply the above cited EN standards in specific technical fields, including CEN/TS 17249:2019;
- With the abbreviation MSD it is intended the Minimum Set of Data, that is the data structure and the data content type to be sent to perform European Emergency Call as per EN 15722:2015;
- With the abbreviation GDPR it is here intended the European General Data Protection Regulation, that is to say the European Regulation n. 2016/679;
- With the term "vehicle category" it is here intended one of the vehicle categories defined as per European Regulation No. 168/2013, which includes the categories L1e, L1e-A, L2e, L3a, L4e, L5e, L6e and L7e, where: L1e vehicle category represents motorcycles, L1e-A vehicle category represents powered cycles, vehicle categories in the range between L2e and L7e include three-wheel vehicles and four-wheel vehicles without external casing to protect the driver and/or the passenger(s); with the term "L-category vehicle" it is here intended a vehicle belonging to any of the above cited categories;
- With the term "helmet lock" 611 it is intended the component which closes the helmet strap, that is to say any embodiment of the mechanical component which connects the two sides of the helmet strap. In other words, the component which closes the helmet strap lets the user fasten the helmet strap and firmly joints, that is to say connects, the two sides of the helmet strap, acting as a mechanical lock between the two sides of the helmet strap and preventing them from unintended release. In the present Description the term "helmet lock" and the sentence "the component which closes the helmet strap" are therefore used with the same meaning;
- With the abbreviation HMI it is here intended as per common technical knowledge the Human-Machine Interface, that is to say the means through which a machine communicates and interacts with the human user.

TECHNICAL FIELD

A flexible electronic control unit 61 is here introduced, which is thought to be installed on helmet strap 62, mainly intended for usage in cycling or motorcycle riding, and whose structure is independent from the structure of the helmet and is installable on any type of helmet; therefore, the same electronic control unit is applicable, as it is, to similar activities requiring a helmet to be worn or for which it is advised to wear a helmet, and its structure is independent from the helmet physical characteristics. Among the activities in which a helmet shall or can be worn, also the following ones are included:

a. The usage of road vehicles in category L1e-A, that is to say powered cycles, or ranging from L1e category to L7e category, that is to say motorcycles and similar two-wheel vehicles, three-wheel vehicles and four-wheel vehicles for professional or personal purpose which are not provided with an external casing for the driver and for the passenger(s);
b. The usage of bicycles, eBikes, scooters and the like for professional or personal purposes;
c. Professional activities in which a helmet is used as safety provision to reduce the consequences against falls or accident on work, including activities in the professional fields of construction, ship building, agriculture and the like;
d. Skiing, snowboarding and sports to be practiced in mountain;
e. Watersports with probability of fall and severe impact, i.e. rafting, as well as the usage of watercrafts and the like.

The flexible electronic control unit for helmet strap 61 contains antennas and electronic components to implement functionalities such as emergency call or automatic alert in case of accident and/or fall, which may happen from vehicle or not.

In case of fall from a road vehicle with VIN, as defined in the ISO 3779 standards, including any vehicle of L1e category with the exception of vehicles of L1e-A category and any vehicles belonging to categories in the range from L2e category to L7e category, the system can perform eCall and also similar services provided through equivalent non-European systems as recognized in ISO 24978:2009, among which "Automatic Crash Notification System" may be firstly considered. In addition to the minimum dataset MSD defined in EN 15722:2015, the electronic control unit for helmet strap 61 can transmit user's blood pressure profile acquired on user's neck 614 or its derived measures or indications to Public Safety Answering Point "PSAP" or to an equivalent Safety Answering Point in case of accident, helping in a quick determination of the injure level. The system stores and can transmit to Safety Answering Point the user's blood pressure profile acquired on user's neck 614 or its derived measures or indications for all its possible use cases and application scenarios, as depicted in the previous points "a.", "b.", "c.", "d." and "e." above.

Taking account of the current European regulations, the system is designed with the following properties, as better described in the following "Best Mode For Carrying Out The Invention" section:

- The system stores and transmits the profile resulting from the measurement of user's blood pressure in an anonymized way, that is to say without identifying personal data, so as to be compliant with current European GDPR;
- For retrofit applications, all the data managed by the system can be measured, stored and retrieved within the system;
- For application on helmets worn while driving new road vehicles of categories L1e, L2e to L7e provided with VIN with the exception of vehicles of L1e-A category, that is to say powered cycles, EN 15722:2015 in the current status might be applied, although not yet compulsory, which requires that data are retrieved from the vehicle; however, thanks to its remote communication unit, as better explained below, the system can also interact with another vehicle on-board unit and/or system for the purpose of data exchange. In this way, the system provides a robust device which intervenes anytime that the on-board system should not completely or correctly detect a fall; vice versa, in case of successful and correct fall detection from the on-board devices, the system provides a bidirectional audio channel to perform eCall and lets the user talk with the rescuers, as well as hear them. Therefore, the system can be used also together with other systems and devices possibly installed on motorcycles and the like to build an overall system, that is to say a system of systems, compliant with EN 15722:2015 and technical specifications and/or regulations related to it, which results more robust and more able to correctly detect any kind of fall.

The system is intended to be applied also on all road vehicles not provided with VIN, as depicted in the points "a." and "b." above, including bicycles; for this reason, the data sent by the system in case of usage while riding road vehicles without VIN includes an adaptation of the Minimum Set of Data (MSD) as per EN 15722:2015; as example, the VIN can be substituted with an equivalent vehicle univocal identification number.

The system can be also applied in scenarios involving vehicles which are not road vehicles or not involving a vehicle but requiring anyway an helmet to be worn, since they show a significant risk of possible sever injures due to falls, as depicted in the points "c.", "d." and "e." above. For these applications too, in case of user's fall, the system can send the data included in MSD, taking account of due adjustments to fit the specific application, can send MSD as a subset of transmittable information.

Therefore, the here described system extends the applicability of systems providing services based on safety and emergency calls and/or messages to scenarios not considered in the current International and/or European standards and regulations.

Moreover, the electronic control unit for helmet strap 61 implements functionalities such as driving assistance and remote connection to electronic control units installed on the cycle in use or on the motorcycle in use or on similar vehicles in use and automatic sound alert to advice for vehicle speed reduction in case of detected uneven bumpy street asphalt. It may also produce synthetized voice messages to let the user hear any other indication from vehicle on-board systems, for example adherence conditions while driving and other relevant information including riding safety alerts, vehicle status alerts and vehicle failure alerts.

Thanks to its architecture, to its functionalities and to its possibility of remote communication with on-board electronic control units, the present invention is able to perform Emergency Call for both new and already-produced two-wheeled vehicles and the like, that is to say vehicles belonging to categories L1e, L3e and from L2e to L7e without an external casing for the driver and for the passenger(s) and not-classified road vehicles without an external casing for the driver and for the passenger(s), therefore requiring an helmet to be worn or for which the helmet wearing is strongly advised, depending on local laws and regulations and on personal choice. Therefore, the invention can:

Be used autonomously, as it is, while riding any already produced and homologated two-wheel, three-wheel or four-wheel vehicle without an external casing for the driver and for the passenger(s), for example motorcycles, representing therefore a retrofit solution for the Emergency Call and the like on already existing vehicles;

Be integrated within In-Vehicle Systems IVS fulfilling the requirements of current CEN/TS 14279-5:2019 and CEN/TS 14279-6:2019 European technical specifications, applicable to new vehicles belonging to categories L1e with the exception of L1e-A vehicle category, that is to say powered cycles, and L3e and from L2e to L7e respectively, and all their possible future modifications, as well as fulfilling the requirements included in current EN 15722:2015, EN 16072:2015 and EN 16102:2011 European regulations and all their possible future modifications, as to completely satisfy their requirements and to provide a more robust and more responsive overall system;

Extend the application of the Emergency Call and the like to all the road vehicles which are not included in the standards and regulations cited as above, i.e. bikes and eBikes as per point "b." above, and to all the applications out of scope of the same standards at the current status, as per points "c.", "d." and "e." above, allowing them to obtain the same functionalities expected from the same standards and/or regulations.

BACKGROUND ART

It is here reported a general overview about the technical state of the art until November 2018. From 2018 the implementation of "eCall" system on board is compulsory for automobiles and commercial vehicles through the European Regulation n. 2015/758, where "eCall" is the name of European Emergency Call system, mainly defined through following regulations:

EN 15722:2015 valid for all vehicle categories, meaning road vehicles, provided with VIN "Vehicle Identification Number" as per ISO 3779:2009, EN 16072:2015 applied to automobiles, EN 16102:2011 applied to automobiles, ISO 15638-10:2017 applied to commercial vehicles.

European Emergency Call, developed through previously named regulations, implies that in case of detected accident or detected emergency condition or on request a voice communication is established automatically among vehicle passengers and PSAP "Public Safety Answering Point", subsequent to an automatic MSD "Minimum Set of Data" message sent from the vehicle on-board system to PSAP. Data structure and minimum content required for MSD is specified within the EN 15722:2015 European Regulation and equivalent ISO International Standards, for example ISO 24978:2009. The ISO 24978:2009 is applicable to Intelligent Transport Systems ITS and refers generically to data concepts, that is to say data models which are sent automatically through a message in case of emergency. EN 15722:2015 standard is applicable to road vehicles provided with VIN and therefore also to any homologated vehicle belonging to the road vehicle categories ranging from L1e to L7e, including cycles and motorcycles of L category, with the exception of Lie-A vehicles, that is to say powered cycles. The same Emergency Call system could be therefore extended, although currently not required, to any road vehicle for which a high probability of severe injuries in accidents occurs, also in case of absence of VIN as defined in ISO 3779:2009; as example, any powered, assisted or not-powered cycle may be considered, as well as to all scenarios depicted in the point "a.", "b.", "c.", "d." and "e." of the previous "Technical Field" section.

Currently, although Emergency Call implementation is not yet considered compulsory for L-category vehicles, in the two years prior to 2018 many systems have been developed to the purpose, some of which take inspiration from existing car system characteristics, as it may be observed for example in the BMW® Motorrad "Intelligent Emergency Call" introduced in 2016. Other technical choices implement a way to place the electronic control unit and the voice microphone in different places, with the objective to keep the voice sensor near the vehicle user, to reduce noise and voice attenuation due to helmet presence between the microphone and the user's head. As example, the product of the German "Digades" ® GMBH may be considered, which was introduced in 2016. A successful "eCall" application requires a safe and robust way to connect electronic control unit on each vehicle and its related microphone; therefore, to keep a high safety level in any emergency circumstances, some enterprises like the Italian "Safeway Helmets" S.p.A. propose new helmets with integrated Emergency Call solutions.

The results of the research of the state of the art carried out for the priority Italian patent application n. IT10201800010063 show that no state-of-the-art device is characterized with the properties of the here claimed system; therefore, the following patent documents represent only generic information: US 2017/221345 A1; WO 2015/153963; WO 2010/005045 A1. The results of the above cited research show that at the state of the art there are some systems which can be generically installed on helmets but not on helmet strap and which are provided with a push button for manual activation of emergency call and a wireless receiver and which do not implement a redundant system electrical and electronic architecture and whose characterizing functionalities are not included in or equivalent to the characterizing functionalities of the present invention, as described and claimed in the following sections of the present document.

Precisely, the results of the research of the state of the art previously carried out show that currently at least one system exists to be installed on helmet composed of an electronic control unit, that is an electronic board surrounded by its case on which the following components are installed:

a microprocessor,
a GPS receiver,
a dedicated battery,
a mobile communication unit,
an inertial tridimensional gyroscope,
accelerometers,
one push button for manual activation of emergency call,
one wireless receiver, And composed of external accelerometers, an external microphone and an external loudspeaker mechanically and electrically connected to the electronic control unit.

Taking account of all the above results, the peculiar characteristics of the here claimed invention are described in the following "Disclosure Of Invention" section.

DISCLOSURE OF INVENTION

The present flexible electronic control unit for helmet strap 61 consists in a solution which is independent from the helmet physical structure, meaning that it may be installed on any helmet, also integral helmets, thanks to its total flexibility and to the narrow openings in the shape of slits 613 provided in the electronic control unit case in which helmet strap can be inserted. As explained in the following "Best Mode For Carrying Out The Invention" section, the narrow openings in the shape of slits 613 in the case are obtained with any production process which does not introduce discontinuities in the structure of the case, i.e. fractures or cracks or holes or the like; therefore, thanks to this aspect, to this particular installation type and to system internal structure, as depicted in the following Description, a robust installation for electronic control unit is granted, as well as the integrity of both the device and the original helmet structure. Moreover, the electronic control unit for helmet strap can acquire user's blood pressure profile in time interval around detected accident instant, so as to determine health status of the user before and after the accident.

As explained in the previous "Technical Field" section, the technical problem which the proposed solution solves can be summed up in the following top-level system requirements derived from an analysis of potential system end users' needs and of operators' needs, here intended as the needs of all the entities which can interact with the system for the provision of eCall or similar services to customers, as well as from current standards and regulations:

Problem no. 1: The system shall be able to perform eCall or similar services, including the extra-European services like the Automatic Crash Notification valid in the U.S.A., automatically in case of fall and/or accident or on manual request for usage on all vehicles belonging to categories ranging from L1-e to L7-e; that is to say, the system shall be a retrofit solution to perform eCall or similar services automatically in case of fall and/or accident or on manual request on all two-wheel vehicles, three-wheel vehicles and four-wheel vehicles without pedals and without an external casing to protect the driver and/or the passengers;

Problem no. 2: The system shall be able to perform automatically or on manual request the same services as per Problem no. 1 also in scenarios and cases not currently included in the European or Extra-European standards, since the letter ones are mostly addressed to road vehicles provided with VIN;

Problem no. 3: When performing Emergency Call on manual request and when applied in scenarios not involving the usage of vehicles, the system shall perform automatically all functionalities needed to remotely connect the user with the Safety Answering Point after the detection of manual activation;

Problem no. 4: The system shall provide rescuers with a full and correct information not only about the place of the accident, but also about the condition of the user during and after the accident, as to ease and quicken the rescue organisation; the information shall be easily transmissible independently from the location where the accident happened;

Problem no. 5: The system shall be able to automatically recognize and store the dynamic characteristic of the user's fall and/or accident, as to provide the extracted information for medical purposes and/or insurance purposes and the like;

Problem no. 6: The system shall be able not only to operate in case of emergency due to fall and/or accident, but also to assist the user in difficult riding conditions and to prevent her/him from having an accident;

Problem no. 7: The system shall operate in a fail-safe manner and be reliable,

Problem no. 7.1: The system shall have high availability, that is to say to be able to recover its functionalities in case of faults, failures or damages on one of its components;

Problem no. 7.2: The system shall have no unexpected operational behaviour;

These requirements imply also that the system shall be robust;

Problem no. 8: The system shall be hands-free to perform eCall in case of fall; that is to say, no action or movement shall be done by the user to activate and/or reach the system;

Problem no. 9: The system shall be provided with good-quality sound input(s) and output(s) in any case of fall and/or accident for the sake of the user and of the Safety Answering Point;

Problem no. 10: The system shall be affordable in terms of costs, especially for usage in workplaces;

Problem no. 11: The system shall be easy to use and easy to install for all its possible applications, especially for usage in workplaces;

Problem no. 12: The system shall not require any other user's device to correctly perform Emergency Call;

Problem no. 13: For usage with future homologated vehicles belonging to categories from L1-e to L7-e with the exception of L1-eA vehicles, that is to say powered cycles, the system shall be able to communicate remotely, that is to say able to exchange information, with an in-vehicle equipment to build a complete IVS, so as to be compliant with current EN 15722:2015 and to fulfil further requirements included in EN regulations and/or technical standards, including CEN TS 17249-5:2019 and CEN TS 17249-6:2019;

Problem no. 14: The system shall not manage, store or send data identifying a physical person, that is to say personal data, for the sake of compliance with European GDPR.

As to solve the problems introduced above, that is to say to fulfil the high-level potential end users' needs and system requirements as described above, it is here proposed a technical solution consisting in a system, whose main new and inventive characteristics are summed up here below:

1.a) System to be installed on helmet composed of an electronic control unit, that is an electronic board surrounded by its case on which at least the following minimum components are installed:

a microprocessor,
a GPS receiver,
a dedicated battery,
a mobile communication unit,
an inertial tridimensional gyroscope,
accelerometers,
one push button for manual activation of emergency call,
one wireless receiver, And composed of external accelerometers, an external microphone and an external loudspeaker mechanically and electrically connected to the electronic control unit, characterized in that:

The system is to be installed on helmet closure strap and is composed of a flexible electronic control unit, that is an electronic board surrounded by its case and made with flexible material, on which at least the following minimum components are installed:

two microprocessors,
two GPS receivers,
two dedicated batteries,
two mobile communication units,
two inertial tridimensional gyroscopes,
two bidimensional accelerometers with X axis along longitudinal direction and Z axis towards the ceiling,
two blood pressure sensors,
two electrical outputs for microphone, and composed of at least two external loudspeakers mechanically and electrically connected to the electronic control unit;

Two terns of external accelerometers are connected to the electronic control unit and positioned inside the helmet, with two sensors placed on the nape of user's neck;

The case surrounding the electronic board is flexible, its size is comparable with the helmet closure strap and it has at least two openings on one of its baseplates through which the strap shall be inserted and no structural discontinuity is present; the case is connected on one side to the helmet lock, that is to say the component which closes the helmet strap, and on the opposite side to a semicircular ring to be installed inside the helmet as mechanical support for two terns of accelerometers, for microphones and loudspeakers connected to the electronic control unit;

Two blood pressure sensors are placed in contact with user's skin, when user wears the helmet;

2.a) The system as per previous point n.1 is characterized with further features, which are reported in the dependent claims; therefore, all the features and the details of system implementation are described in the subsequent "Best Mode For Carrying Out The Invention" section of the present document.

DESCRIPTION OF DRAWINGS

To the present Description drawings n.3 are attached, whose content is explained in following Table n.1 and which are intended to be an elementary illustration of the main characteristics of the system, not preventing other embodiments to be used for the production of the system, as long as they are coherent with the present Description. The meaning associated to the indexes in drawings is reported in Table n.2.

TABLE 1

Figure 1:
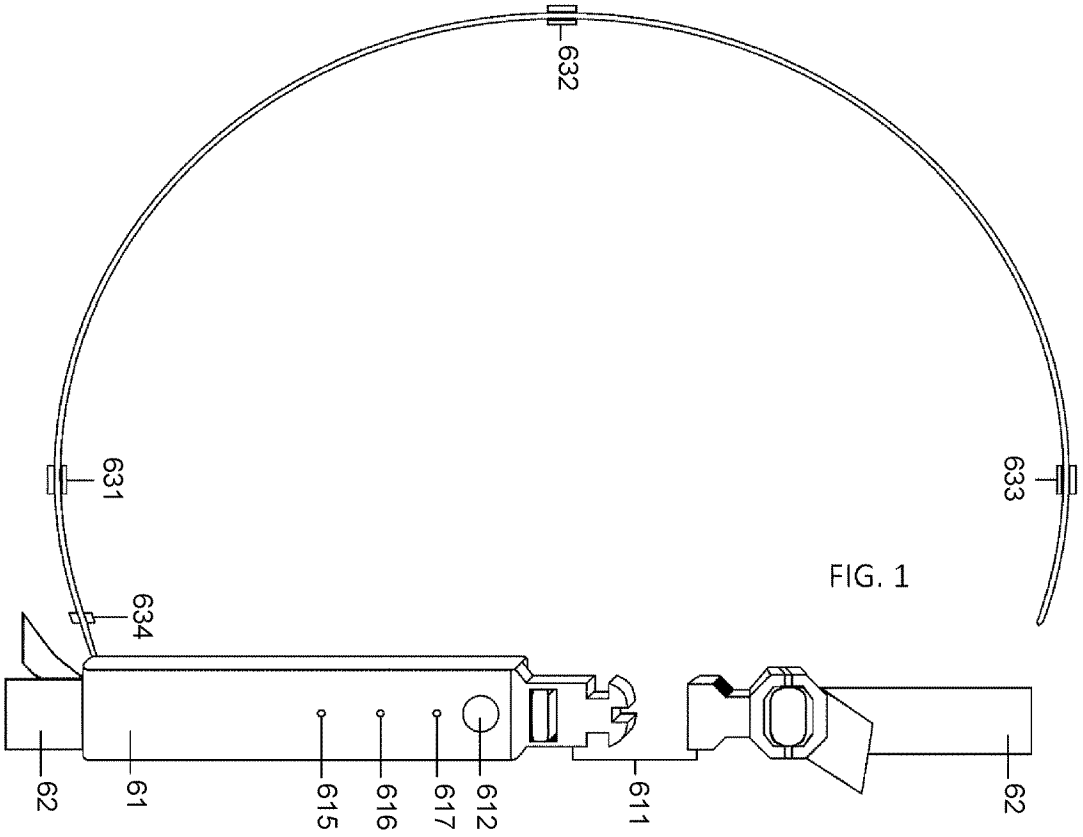
Figure 2:
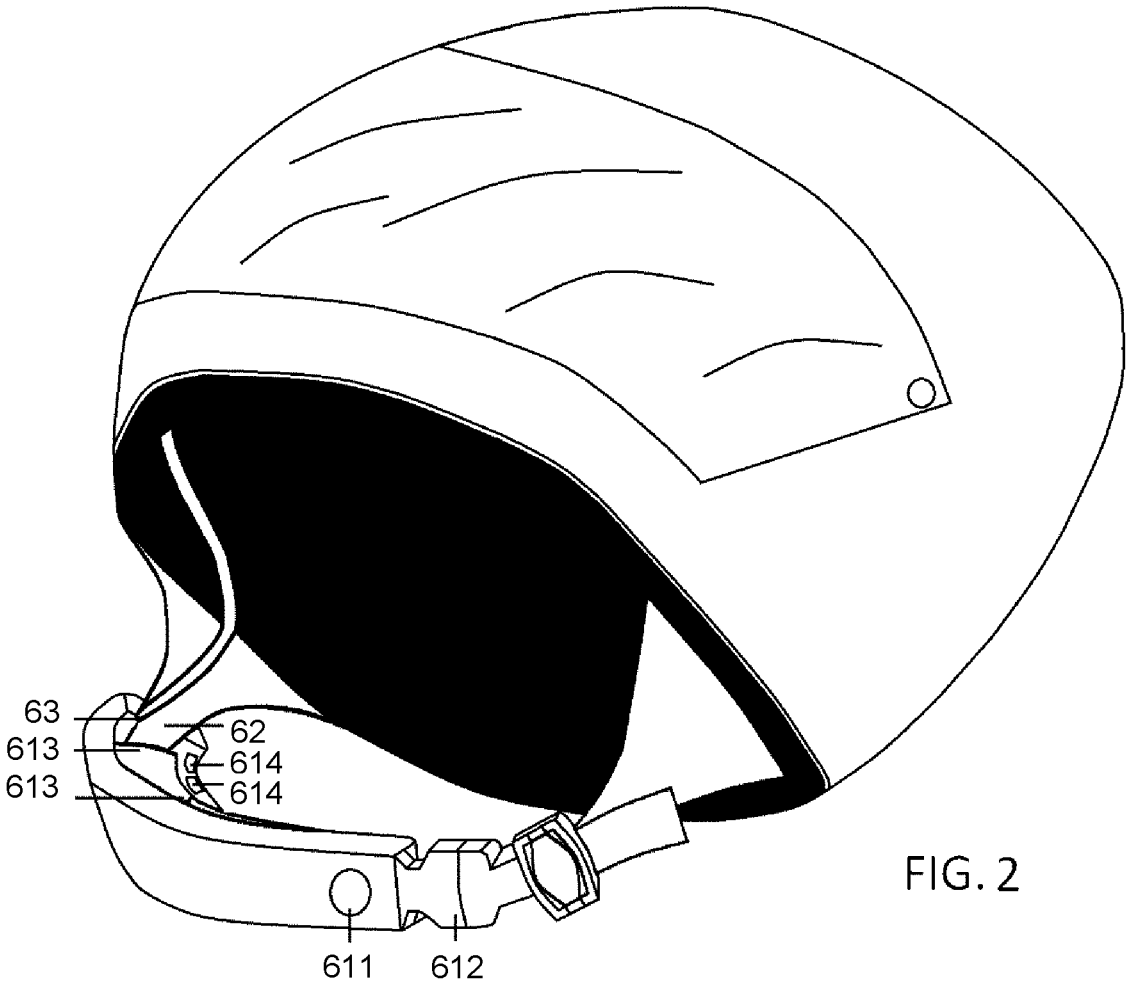
Figure 3:
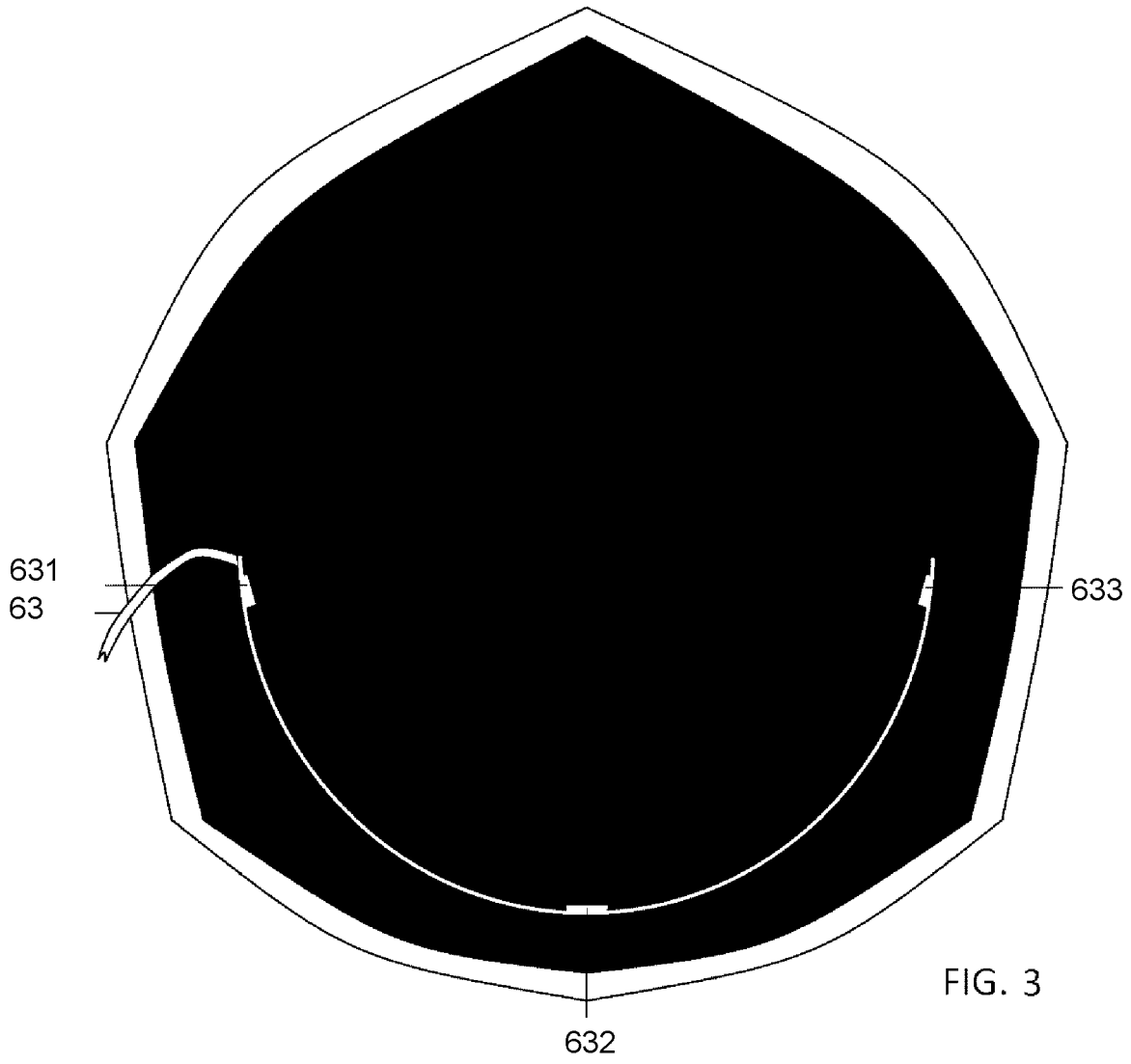

| FIG. n. | Associated representation |
|---|---|
| FIG. n.1 | Drawing of the system which is object of present description |
| FIG. n.2 | Drawing of the system installed on a generic helmet - Frontal view |
| FIG. n.3 | Drawing of the system installed on a generic helmet - Transverse section, bottom view |

TABLE 2

| Index n. | Associated meaning |
|---|---|
| 61 | Flexible electronic control unit - Case |
| 62 | Helmet strap |
| 611 | Helmet lock, that is to say the component which closes the helmet strap, containing an integrated Hall-effect sensor |

TABLE 2-continued

| Index n. | Associated meaning |
|---|---|
| 612 | Switch for manual activation of emergency call, here represented as a pushbutton |
| 63 | Semicircular ring fixed to the case of the electronic control unit |
| 631 | Anchorage point for the lateral couple of external accelerometric sensors n.1 and for speakers |
| 632 | Anchorage point on the nape of user's neck for the couple of external accelerometric sensors n.2 |
| 633 | Anchorage point for the lateral couple of external accelerometric sensors n.3 and for speakers |
| 613 | Narrow openings in the shape of slits on the internal side of the flexible electronic control unit through which the helmet strap is inserted |
| 614 | Measuring point for the blood pressure sensors |
| 634 | Anchorage point for a couple of microphones |
| 615 | Red LED light for visual signaling of system status (diagnostics) |
| 616 | Amber LED light for visual signaling of system status (diagnostics) |
| 617 | Green LED light for visual signaling of system status (diagnostics) |

BEST MODE FOR CARRYING OUT THE INVENTION

The flexible electronic control unit for helmet strap 61 is implemented internally with parallel-redundant electrical architecture to reach fault tolerance, which is identified with technical term of "fail-safe" architecture, containing therefore two twin control systems made with identical components working in functional redundant parallelism; in this way, in case of single failure inside one of the two control systems, the overall system functionalities are not lost and continue to be working, treating them as high-level safety functionalities.

The two control systems, internal to the electronic control unit, are so composed:

1.b) Control system n.1 is composed with internal battery system as power supply, microprocessor, mobile communication unit implementing UMTS or superior technologies if possible, GPS receiver, gyroscope for measurement of roll and pitch angles, two-axial accelerometric sensor with X axis directed along vehicle speed direction, Z axis in vertical direction towards the ceiling and a blood pressure sensor. To control system n.1 three external accelerometric sensors are also connected to measure dynamically the pressure exerted from outside to inside the helmet, two of which placed along vehicle lateral direction, that is to say transversal to vehicle longitudinal direction, 631 633 and one placed on the nape of user's neck 632. To control system n.1 two loudspeakers are connected through electrical wiring; control system n.1 contains also a wired cabled output through which a microphone is connected. A semicircular structure, for example a semicircular ring, 631 shall be installed inside the helmet as mechanical support to the external accelerometers 631 632 633, the microphone 634 and the loudspeakers 631 632;

2.b) Control system n.2 is symmetric to control system n.1, therefore it contains internal battery system as power supply, microprocessor, mobile communication unit implementing UMTS or superior technologies if possible, GPS receivers, gyroscope for measurement of roll and pitch angles, two-axial sensor with X axis placed along vehicle speed direction and Z axis placed along vertical direction towards the ceiling and a blood pressure sensor. To control system n.2 a second tern of accelerometers 631 632 633, measuring dynamic pressure from outside to inside the helmet, is connected through wires. Two sensors of the tern are placed along vehicle lateral direction, transversal to longitudinal vehicle speed direction 631 633; the third sensor is placed on the nape of user's neck 632. To control system n.2 two further loudspeakers are connected through wires; the control system n.2 contains also an electrical output with attached wire for microphone. The accelerometers are installed on the same semicircular structure as described in previous point "1.b", which is the mechanical support for a second redundant microphone 634 and the two redundant loudspeakers and their related wired connection, as per FIG. n.3;

3.b) To both control system n.1 and control system n.2 following elements are connected:

An integrated switch to manually activate Emergency Call on user need, i.e. a push button 612;

A Hall-effect inductive sensor to detect the closure of the helmet lock, that is to say the component which closes the helmet strap 611;

A single receiver for remote communication with vehicle electronic control units; the receiver might be implemented with any connection technology provided in on-board systems and it is provided with an independent power supply.

It is implicitly intended that the electronic control unit will be provided also with a proper memory to perform its operations, which is considered as part of the state of the art and it is not therefore here further described.

It is also implicitly intended that the system contains also two inputs on which the two electrical outputs for microphone are connected; thanks to the presence of two electrical outputs with attached wires for microphone in the flexible electronic control unit, the system can be designed to have one microphone connected with two wires to the two control systems or equivalently one microphone unit connected with two wires to the two control systems, where with the term microphone unit is intended as an array of or a bunch of microphones and the like which are activated in turns through a dedicated logic, or two redundant microphones, one for each control unit, or any further possible architecture; therefore, although the minimum architecture provides one microphone, the most advisable system architecture is with two microphones.

Externally, the electronic control unit appears as a flexible rectangular component, therefore as a flexible case 61 surrounding an internal flexible electronic board, with dimensions comparable with the helmet strap 62. The electronic control unit for helmet strap is provided with a case 61 with at least two narrow openings in the shape of slits 613 on its back baseplate so as to insert a portion of the helmet strap inside; the two sides of the helmet strap are connected on the closure of the helmet lock, that is to say of the component which closes the helmet strap 611, mechanically and electrically connected to one side of the electronic control unit. The above cited narrow openings in the shape of slits 613 shall be produced with any method which maintains the structural integrity of the case, that is to say which keeps the structure of the case intact; therefore, the slits 613 shall be obtained without the creation of structural discontinuities in the case; as example, no fracture, hole or crack in the baseplate of the case is allowed as slit 613 through which the helmet strap can be inserted; vice versa, a narrow loop or a flat loop in the shape of a belt loop applied on the baseplate or a part of the flexible material of the baseplate bent as a folder and closed on two sides of its perimeter forms two slits 613 through which the helmet strap can be inserted. Laterally, on the opposite side of the component which closes the helmet strap 611, a semicircular structure, for example a semicircular ring, 631 is fixed to the electronic control unit; the structure shall be inserted inside the helmet and contains the two terns of accelerometers 631 632 633, at least one microphone or better two microphones at most 634 and the loudspeakers 631 633 as previously described and as per FIG. n.2 and FIG. n.3. Mobile communication units and GPS antennas shall be placed towards the outside, that is to say on the front side of the electronic control unit; vice versa, blood pressure sensors shall be placed in contact with user's skin 614, therefore on the back baseplate of electronic control unit, next to the narrow openings in the shape of slits 613 and with sensor surface not covered from the helmet strap 62 or from the component which closes the helmet strap 611. A first example for obtaining this result consists in the realization of one or more openings, that is to say slots, on the backside of the case of the electronic control unit to support two blood pressure sensors 614 and of one or more openings on the front side of the same dedicated to the switch 612, as per FIG. n.2. However, a second possible embodiment consists in the switch 612 left completely inside the case 61; the switch 612 can be easily pressed since the case 61 is made with flexible material and, for the fact that no opening for the switch 612 is created in this embodiment, the structure of the case results continuous and more robust. In the same way, structural discontinuities, that is to say cracks, fractures, holes, cuts and empty spaces in the structure of the case 61 and the like, shall be avoided in the realization of the case 61; taking account of the solutions previously explained for the narrow openings in the shape of slits 613 and for the switch 612, this condition can be completely reached for example in the following way: the case 61 is made through the bond of planar continuous surfaces which constitute the faces of the case; the external corners of the element composing the case 61 are made with a round profile following a concave curve, as not to create part of a hole; the passage for the wires which connect the external sensors on the semicircular ring and the blood pressure sensors with the internal components of the electronic control unit is created placing the wires between the bonded edges of the elements which compose the case 61, which shall be aligned and firmly joint, so as to keep the continuity of the structure of the case 61. More in general, for any other possible embodiment, whenever it is strictly necessary to create a space in the case to insert an object, this shall be completely filled with a flexible bonding material to create a bond between the inserted object and the case 61.

Other elements might be present in the case for purposes already known at the state of the art and therefore here not further explained; in these cases, all the considerations about the system's properties made in this document apply. For example, as to complete system's Human-Machine Interface HMI, three additional LEDs could be present for visual on-system diagnostics, as known from the state of the art and as shown in FIG. n.1, where the three LEDs are a red LED light 615 to indicate permanent failure, an amber LED light 616 to indicate an error not precluding system's functionalities and a green LED light 617 to confirm the correct status of the system, ready for operation.

The electronic control unit 61 shall turn on when user fastens the two sides of the helmet strap 62 through the helmet lock, that is to say the component which closes the helmet strap 611, thanks to the Hall-effect sensor. The signal from inductive sensor activates both blood pressure sensors 614; if pressure is measured as positive, the system detects that user has just worn the helmet and turns all accelerometers and gyroscopes on, which are connected to both control systems as previously described and will be operating for the whole travel duration, as long as user does not manually open the helmet lock, that is to say the component which closes the helmet strap 611, and if no emergency call is ongoing at the moment of the opening of the helmet strap, that is to say the component which closes the helmet strap 611.

While travelling, each control system composing electronic control unit memorizes cyclically within time intervals of at least 16 seconds:

Measurement of roll and pitch angles;

Accelerometric peak along longitudinal vehicle speed direction, therefore along X axis; positive and negative values of acceleration shall be identifiable;

Force peak or pressure peak from outside to the inside of the helmet, which shall be measured and registered through the two available terns of accelerometers placed on the semicircular ring inside the helmet.

While travelling, the accelerometric sensors placed inside the electronic control unit measure variations along vertical Z axis; if the measured values for accelerometric signal and the pitch angle for not-null vehicle speed are detected periodically above thresholds, the system detects the presence of potholes and humps in street asphalt, that is to say uneven bumpy asphalt; therefore, it advices the user for speed reduction through a sound alert, as long as at least one of the two measured signals along Z axis from operating sensors is over threshold.

If at least one of the two control systems composing the electronic control unit detects in a minimum time interval, that is to say a minimum time window, of 16 seconds the following travelling conditions:

Pitch angle above vehicle overturning threshold or

Side fall detected through helmet pressure peak measurement in coherence with roll angle measurement or Backward fall detected through helmet pressure or force peak on the nape of user's neck in coherence with pitch angle value or Accelerometric peak along X axis, depicting a frontal anelastic impact, control system n.1 activates automatically procedure for Emergency Call, therefore it turns the mobile communication unit and the GPS receiver on and prepares the emergency message, that is MSD for European application containing information required as per EN 15722:2015 (date, time and place of accident, vehicle type, motor type, etc.) as well as user's blood pressure profile or its derived measures, such as heartbeat value for 3 seconds after the accident, so as to understand user's health status after the event, or a first indication regarding the severity level of the accident derived from the same blood pressure profile. Control system n.1 executes voice call towards Public Safety Answering Point "PSAP" directly or with third-party support, as per EN 16072:2015 and EN 16102:2011 respectively.

Obviously, for applications not involving a vehicle provided with VIN as depicted and explained in the points "a.", "b.", "c.", "d." and "e." of the previous "Technical Field", the data contained in the emergency message can be adapted taking as reference the structure of MSD.

At the moment of the detected accident also control system n.2 activates its GPS receiver and the mobile communication unit and prepares the emergency message, that is to say the MSD for European application, with user's blood pressure profile or its derived measures, as previously described. Control system n.2 waits for confirmation of Emergency Call execution from control system n.1 through a proper electric signal between microprocessors. If confirmation is not received, control system n.2 sends the emergency message, that is to say the MSD for European application, together with user's blood pressure profile and, if possible, further derived measures as previously described to PSAP or the like and substitutes control system n.1 in the activation of the voice call. Control system n.2 shall be ready to execute operations for the whole duration of Emergency Call as long as the call-closing command is not received and shall be able to substitute control system n.1 in case of failures or in case of lack of power supply while in emergency condition.

In case of normal operation, that is to say if control system n.1 is correctly working without failures, the PSAP or the like will continue to receive from control system n.1 MSD consequent messages containing real-time measurement of user's blood pressure profile or its derived measures or indications, if not differently requested from PSAP, as previously described.

The system shall keep Emergency Call alive as long as it is not closed from PSAP, also in case the user opens the component which closes the helmet strap 611 to unfasten the helmet strap. The electronic control unit for helmet strap 61 is designed so that on user switch pressure 612 Emergency Call or an equivalent authorized service is immediately executed as above described.

In case the riding activity requires the user to wear a helmet, or in case the helmet is advised for riding, and the cycle, motorcycle or vehicle is provided with a wireless communication unit, the electronic control unit for helmet strap may include a wireless communication unit compatible with the technology installed on vehicle, so as to let it send commands to the system for multiple purposes, also for playing predefined voice messages; precisely, in case of availability of a wireless receiver on the user's vehicle, the system receives information sent from on-board electronic control units about adherence conditions while vehicle is moving, selects a synthetized voice message coherent with received information and commands loudspeakers installed on the semicircular ring to play it. In this way, user may automatically hear indications about adherence conditions and further information about vehicle's status, vehicle's sensors detection, vehicle's route and the like; in other words, only for the above cited functionality, the system works also as part of the vehicle's Human-Machine Interface HMI.

It can be promptly realized from those skilled in the art that various modifications and changes can be made to the present invention without following the example embodiments and applications illustrated and described in the present document, without departing from the scope of the present disclosure.

The invention claimed is:

1. A safety, emergency and driving assistance system configured to be installed on a helmet, the system comprising:

a) a flexible case including first and second slits adapted to receive a closure strap of the helmet;

b) a semicircular ring adapted to be received within the helmet wherein the semicircular ring has a first end coupled to the case;

c) a flexible electronic control unit disposed within the case, wherein the flexible electronic control unit comprises an electronic board, wherein the electronic board includes at least:

i) two microprocessors, ii) two GPS receivers, iii) two batteries, iv) two mobile communication units, v) two inertial tridimensional gyroscopes;

vi) two bidimensional accelerometers;

d) first and second sets of three accelerometers each attached and communicatively coupled to the electronic control unit, wherein each of said first and second sets of three accelerometers include a first accelerometer coupled to the semicircular ring and configured to be located proximate to one ear of the user, a second accelerometer coupled to the semicircular ring and configured to be located proximate to the other ear of the user, and a third accelerometer coupled an intermediate distance along the semicircular ring and configured to be located proximate a nape of a neck of a user;

e) an external microphone mounted on the semicircular ring, wherein the external microphone is communicatively coupled to the electronic control unit;

f) a first external loudspeaker mounted on the semicircular ring proximate to the first end of the semicircular ring and configured to be located proximate one ear of a user, wherein the first external loudspeaker is communicatively coupled to the electronic control unit;

g) a second external loudspeaker mounted on the semicircular ring and configured to be located proximate the other ear of the user, wherein the second external loudspeaker is communicatively coupled to the electronic control unit;

h) a wireless receiver attached to the case and wherein the wireless receiver is adapted to receive an external wireless signal and communicate the signal to the user through the first and second external loudspeakers;

i) first and second blood pressure sensors attached to the case, wherein the first and second blood pressure sensors are configured to contact a user's skin when the helmet is being worn; and j) a push button mounted to the case and configured to manually activate an emergency call when actuated.

2. The safety, emergency and driving assistance system in accordance with claim 1 further comprising a Hall-effect sensor configured to be mounted onto a helmet lock disposed on the helmet strap, wherein the Hall-effect sensor is electrically coupled to electronic control unit and operable to sense when the helmet lock is closed.

3. The safety, emergency and driving assistance system in accordance with claim 1 wherein each of the two microprocessors on the electronic board is configured to:

a) acquire a measurement of response peak of signals from the said accelerometers located proximate the nape of neck of the user and from the said gyroscopes on the electronic board and calculate from at least one of said accelerometers located proximate the nape of neck of the user and said gyroscopes if a pitch overturn has occurred, b) acquire a measurement of response peak along the X axis of at least one accelerometer on the electronic board and calculate if a frontal impact of the user's head has occurred, and c) command delivery of at least one emergency message which provides a real-time blood pressure profile of a user as measured by at least one of the first and second blood pressure sensors.

4. The safety, emergency and driving assistance system in accordance with claim 1 wherein each microprocessor is configured to acquire a measurement of a response peak along a Z axis of at least one of said bidimensional accelerometers and calculate a possible presence of uneven or bumpy asphalt and command the loudspeakers to play a sound alert.

5. The safety, emergency and driving assistance system in accordance with claim 1 wherein the electronic control unit is configured to communicate with a user's vehicle, wherein the electronic control unit communicates adherence conditions while the vehicle is moving, and wherein the electronic control unit includes a voice message database and wherein the electronic control unit is configured to select a voice message from said voice message database coherent with the adherence conditions and command the loudspeakers to play the voice message.

* * * * *